United States Patent [19]

Savikurki et al.

[11] Patent Number: 4,573,929

[45] Date of Patent: Mar. 4, 1986

[54] PROPELLER DEVICE FOR A SHIP

[75] Inventors: Jarmo Savikurki; Kim Jansson, both of Rauma, Finland

[73] Assignee: Hollming Ltd., Finland

[21] Appl. No.: 574,992

[22] Filed: Jan. 30, 1984

[30] Foreign Application Priority Data

Feb. 3, 1983 [FI] Finland ..... 830373

[51] Int. Cl.[4] ..... B63H 5/12

[52] U.S. Cl. ..... 440/54; 192/67 R; 192/85 C; 403/1

[58] Field of Search ..... 440/54, 61, 112; 403/1; 192/67 R, 85 C

[56] References Cited

U.S. PATENT DOCUMENTS

| | | | |
|---|---|---|---|
| 2,626,821 | 1/1953 | Bouget et al. | 403/1 |
| 2,739,685 | 3/1956 | Paulavich | 192/67 R X |
| 3,760,920 | 9/1973 | Delfeld | 192/67 X |

FOREIGN PATENT DOCUMENTS

| | | | |
|---|---|---|---|
| 42174 | 2/1970 | Finland | 440/61 |
| 2222268 | 10/1974 | France | 440/61 |

*Primary Examiner*—Sherman D. Basinger

*Attorney, Agent, or Firm*—Steinberg & Raskin

[57] ABSTRACT

A propeller device for a ship rotates 360° and may be raised when it is not in use. The transmission system of the propeller device includes a drive shaft for the propeller device, which is placed in the upper part of such propeller device. The shaft is driven by the shaft of the engine and transmits rotation via an upper angular gearbox to a vertical shaft and a lower angular gearbox to a propeller shaft at the bottom part of the propeller device. A coupling is fitted between the drive shaft of the propeller device and the engine shaft rotating same. A coupling member of the coupling permits the propeller device to be uncoupled from the engine and to be displaced in the axial direction, so that the propeller device may be raised.

12 Claims, 7 Drawing Figures

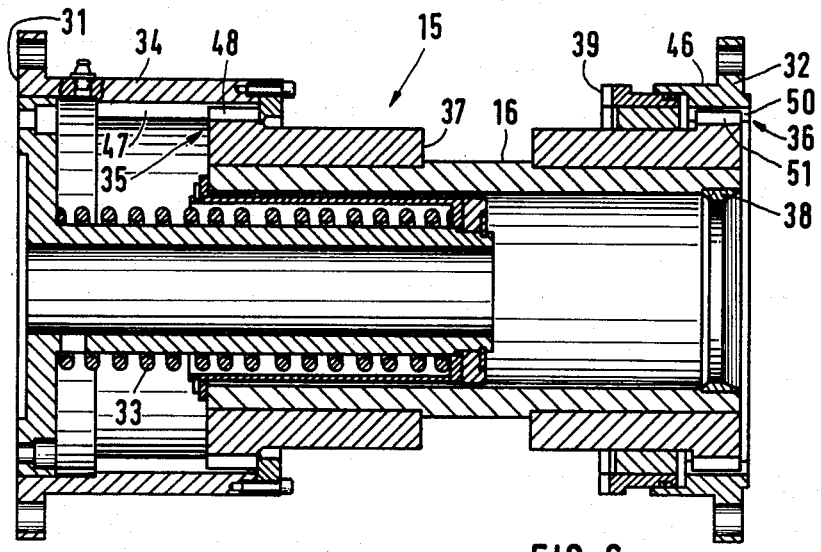
FIG. 6
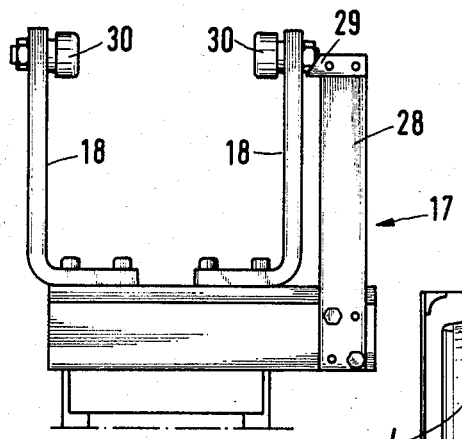
FIG. 5
FIG. 7
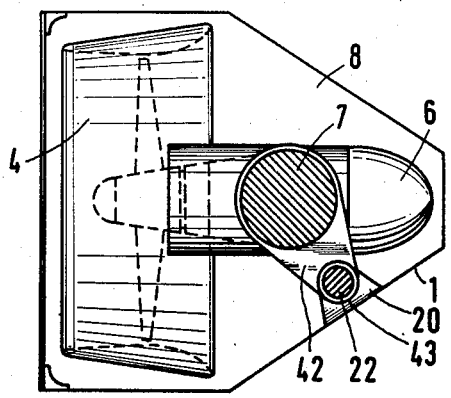

PROPELLER DEVICE FOR A SHIP

BACKGROUND OF THE INVENTION

The present invention relates to a propeller device for a ship. More particularly, the invention relates to a propeller device which may be raised when it is not used.

The transmission system of the propeller device comprises a drive shaft for said propeller device, placed in the upper part of said propeller device and driven by the shaft of the engine, and from which rotation is transmitted via an upper angular gearbox to a vertical shaft and via a lower angular gearbox to the propeller shaft at the bottom of said propeller device.

A propeller device usually turns through 360°, that is, a full circle, whereby the ship may be steered by turning the propeller device. The propeller device can usually also be raised, because in such a case it is possible, if necessary, to sail even in exceptionally shallow waters. In connection with docking of the ship, it is also advantageous if the propeller device can be raised into shelter, for example, into a well formed in the bottom of the ship.

In prior-art raisable propeller devices, the transmission from the engine shaft to the drive shaft of the propeller device is via an intermediate shaft, both ends of which are provided with universal joints. In such a case, when the propeller device is in operation, that is, in its lower position, the intermediate shaft is directed diagonally downwards and forms an angle with both the power take-off shaft of the engine and the drive shaft of said propeller device. Correspondingly, when the propeller device is raised, the intermediate shaft is directed upwards from the engine. If the intermediate shaft is sufficiently long, the angles may be made to remain within permitted limits. Thus, for example, the angle between shafts connected by means of universal joints may be a maximum of about 6° during transmission of power, and even without load only about 15°. At high rotary speeds, the permitted angles are even smaller. When great power is transmitted, the size of the shaft increases, whereat the permitted angle between the shafts is decreased. Furthermore, since a large propeller requires a large vertical movement of the propeller device, the shaft between the engine and said propeller device becomes considerably long. A long intermediate shaft creates problems of support and a risk of various vibrations. In addition, as a rule, a ship does not have space for very long shafts.

SUMMARY OF THE INVENTION

The principal object of the invention is to provide a propeller device which eliminates the above drawbacks and is more advantageous than the devices of the prior art.

An object of the invention is to provide a propeller device in which the transmission between the engine and the propeller may be decoupled, so that the transmission does not restrict the vertical movement of the propeller at all.

Another object of the invention is to provide a propeller device in which the shaft between the engine and the propeller may be very short, thereby eliminating all the problems caused by a long shaft.

Still another object of the invention is to provide a propeller device in which the coupling can be easily arranged so that it operates automatically when, for example, the raising and lowering movement of the propeller device is remote-controlled from the bridge of the ship.

In accordance with the invention, a coupling is fitted between the drive shaft of the propeller device and the engine shaft rotating same, whereby said propeller device may be uncoupled from the engine via a coupling member of said coupling and displaced in the axial direction, so that said propeller device may be raised.

In accordance with the invention, a propeller device for a ship has a propeller, an upper part and a lower part, and a transmission system for transmitting rotation from an engine having an engine shaft to the propeller, the transmission system including a drive shaft in the upper part of the propeller device, the drive shaft being driven by the shaft of the engine, an upper angular gearbox coupled to the drive shaft, a vertical shaft coupled to the upper angular gearbox, a lower angular gearbox coupled to the vertical shaft and a propeller shaft in the lower part of the propeller device coupled to the lower angular gearbox. The propeller device comprises a coupling having a coupling member between the drive shaft of the propeller device and the engine shaft whereby the propeller device may be uncoupled from the engine via the coupling member, the coupling member being displaceable in axial directions, so that the propeller device may be raised.

The ship has a bottom and a well formed in the bottom, the well having a top and a wall, the propeller device being positioned underneath the bottom of the ship in use, so that the propeller device may be raised into the well when out of operation. The propeller device further comprises raising means for raising the propeller device into the well, the raising means including a vertical hydraulic cylinder in the well alongside the propeller device, the cylinder having a bottom end affixed to the wall of the well and a top end affixed to the top of the well, a support plate supporting the propeller device at its lower part in the well, a slide ring mounted on the hydraulic cylinder and the hydraulic cylinder functioning as a guide, a piston in the hydraulic cylinder passing through the top of the well to above the top, and having an upper end affixed to the upper part of the propeller device, the piston producing a raising movement of the propeller device.

The coupling member comprises an intermediate shaft coupled to the drive shaft of the propeller device.

The raising means further comprises a fastening bracket affixing the bottom end of the vertical hydraulic cylinder to the wall of the well.

A toothed coupling couples the intermediate shaft to the drive shaft, the toothed coupling permitting axial movement of the intermediate shaft relative to the drive shaft.

A spring urges the intermediate shaft toward the engine shaft, so that the coupling remains coupled.

A hydraulic actuating device is adapted to be controlled from a remote point, for shifting the intermediate shaft in an axial direction apart from the engine shaft to uncouple the coupling.

Another toothed coupling couples the intermediate shaft to the engine shaft.

The intermediate shaft has a shoulder and the actuating device includes a displacing lever supported against the shoulder of the intermediate shaft.

A toothed coupling couples the intermediate shaft to the drive shaft, the toothed coupling permitting axial movement of the intermediate shaft relative to the drive shaft and another toothed coupling couples the intermediate shaft to the engine shaft. The actuating device includes a rotating member acting on the another toothed coupling when the coupling is coupled and a locking hook supported on the ship for preventing raising of the propeller device from a lower position when the coupling is coupled and lowering of the propeller device to the lower position when the intermediate shaft is displaced axially to its position corresponding to the coupling being coupled.

The toothed coupling and the another toothed coupling are spherical thereby permitting both an angular error and a lateral shift between the drive shaft and the engine shaft.

BRIEF DESCRIPTION OF THE DRAWINGS

For a fuller understanding of the invention, reference is had to the following description, taken in connection with the accompanying drawings, in which:

FIG. 5 shows, on an enlarged scale, the displacing member located in the upper part of the actuating device of FIG. 4 of the propeller device of the invention, as viewed in the direction of the shaft;

FIG. 6 is a sectional view, on an enlarged scale, of the coupling of the propeller device of the invention; and FIG. 7 is a sectional view, taken along the lines VII—VII, of FIG. 1.

DESCRIPTION OF PREFERRED EMBODIMENTS

Figure 1:
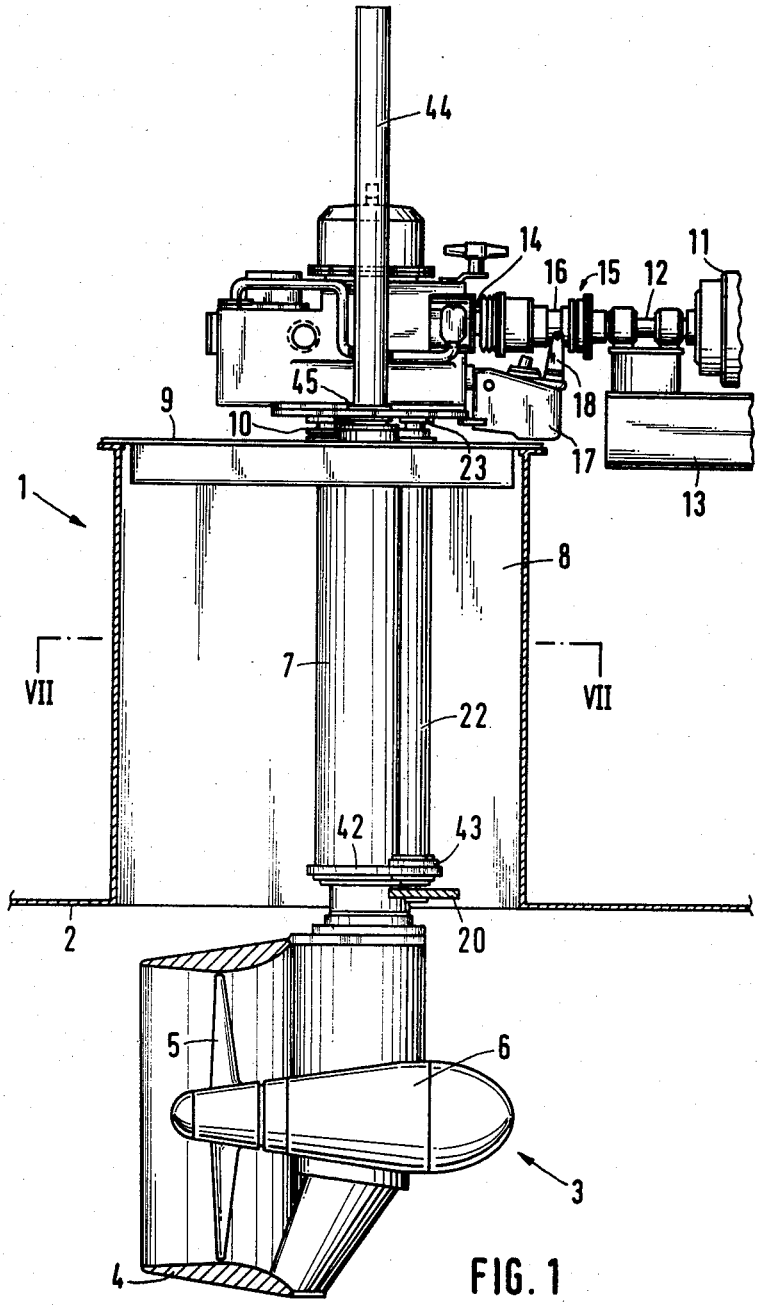
FIG. 1 is a side view of an embodiment of the propeller device of the invention installed in the bottom of a ship and in its lower position.
Figure 2:
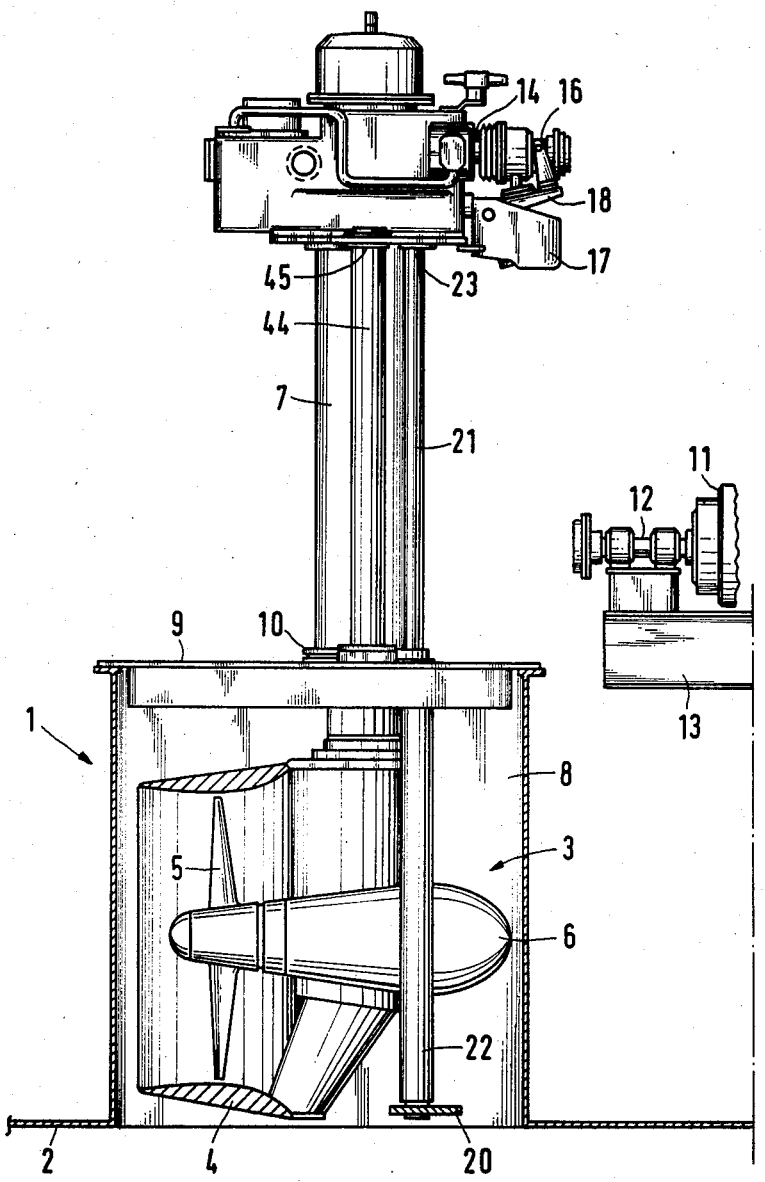
FIG. 2 is a side view of the embodiment of FIG. 1 with the propeller device raised.

FIG. 1 shows the propeller device 3 of the invention installed in the bottom 2 of a ship 1. The underwater part of the propeller device includes a propeller 5 inside an annular propeller nozzle 4, a lower angular gearbox 6, and a frame part 7 of said propeller device, placed above said lower angular gearbox. A well 8 is formed in the bottom 2 of the ship to accommodate the propeller device. The well 8 has a top 9 with a sealed lead-in 10. The well 8 is dimensioned so that the lower part of the propeller device fits into it. Thereby, if necessary, the propeller device 3 may be raised so that said propeller device may be brought completely into shelter above the bottom 2 of the ship. The top 9 of the well 8 is provided with guide columns 44 supporting the propeller device 3 in the lateral direction. The upper part of the propeller device is provided with corresponding slide rings 45. FIG. 2 shows the propeller device of the invention in its raised position.

Before the propeller device 3 shown in FIG. 1 can be raised, the drive shaft 14 of said propeller device must be uncoupled from the engine. In FIG. 1, the flywheel 11 of the engine is shown schematically, the shaft 12 connected to same being journalled on the hull 13 of the ship. The shaft 12 is connected to the drive shaft 14, located in the upper part of the propeller device, by a coupling 15. The coupling 15 includes an intermediate shaft 16 displaceable in axial directions. The shaft 16 is displaced to the left in FIG. 1 by a hydraulic actuating device 17 for the purpose of uncoupling or disengaging the coupling 15.

In its raised position, shown in FIG. 2, the propeller device is completely above the bottom 2 of the ship. Before the propeller device is raised, its drive shaft 14 is uncoupled from the shaft 12 coming from the engine, or, more particularly, from the flywheel 11 of the engine. In uncoupling the shafts 14 and 12, the intermediate shaft 16 is shifted by a displacing lever 18 of the actuating device 17 in the axial direction to the left of FIG. 2. When the propeller device is uncoupled from the engine, it can be displaced in the vertical direction. When the propeller device is lowered, the drive shaft is coupled to the engine in the opposite sequence, of course.

Figure 3:
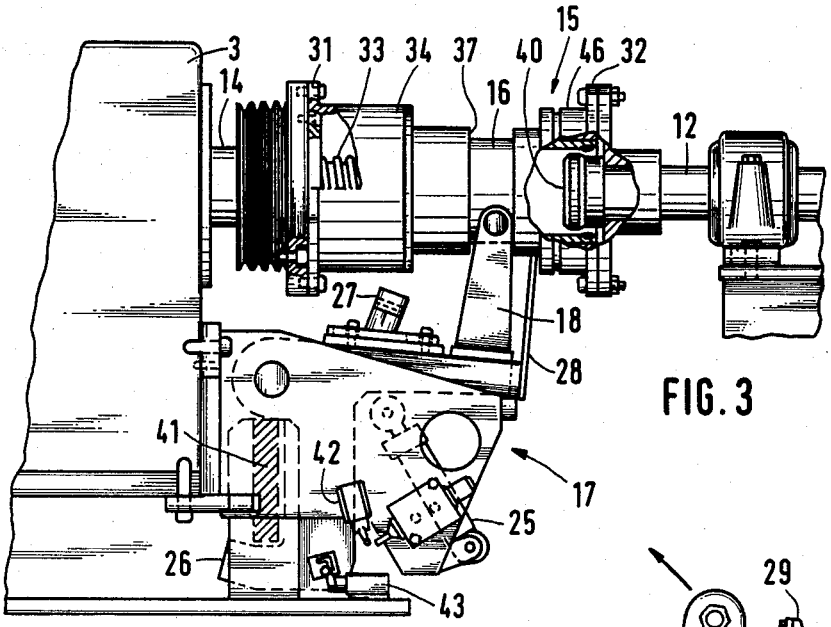
FIG. 3 is a side view, on an enlarged scale, of the drive shaft and the coupling of the propeller device, and the actuating device.

FIG. 3 shows the coupling 15 between the drive shaft 14 of the propeller device 3 and the shaft 12 from the engine, and the actuating device 17 of said coupling. The coupling 15 includes an intermediate shaft 16 rotating with the drive shaft 14 and displaceable in axial directions. Movement in axial directions is provided by a toothed coupling, which connects the intermediate shaft 16 to a sleeve 34 attached to the drive shaft 14. A spring 33 in the sleeve 34 urges the intermediate shaft 16 to the right in FIG. 3, so that the coupling 15 is in engagement. A toothed coupling is also provided between the intermediate shaft 16 and a sleeve 46 attached to the shaft 12 of the engine. The coupling 15 is then uncoupled, so that the teeth of the halves of the toothed coupling are uncoupled from each other by displacement of the intermediate shaft 16. In FIG. 3, the coupling 15 is coupled, whereat the sleeve-shaped intermediate shaft 16 is located around a guide pin 40 inside the sleeve 46 attached to the shaft 12 of the engine.

The coupling 15 is uncoupled by the actuating device 17, so that the displacing lever 18 shifts the intermediate shaft 16 to the left in FIG. 3. The toothed coupling between the sleeve 46 and the intermediate shaft 16 is thereby disengaged. At the same time, a brake 27 is pressed against the sleeve 34 connected to the drive shaft 14 of the propeller device 3, thereby preventing rotation of said drive shaft. A locking hook 26, acting as a safety device, also moves away from behind a locking beam 41. The purpose of the locking operation is to prevent rising of the propeller device while the transmission from the engine to said propeller device is in engagement. The hook 26 also acts as a safety device when the propeller device is being lowered from its raised position. If, at that time, the intermediate shaft 16 has, for some reason, been shifted towards the shaft 12 of the engine, that is, to the right in FIG. 3, the lower edge of the hook 26 attached to the displacing lever 18 abuts the locking beam 41, thereby preventing abutment of the coupling components attached to the shafts 14 and 12.

Figure 4:
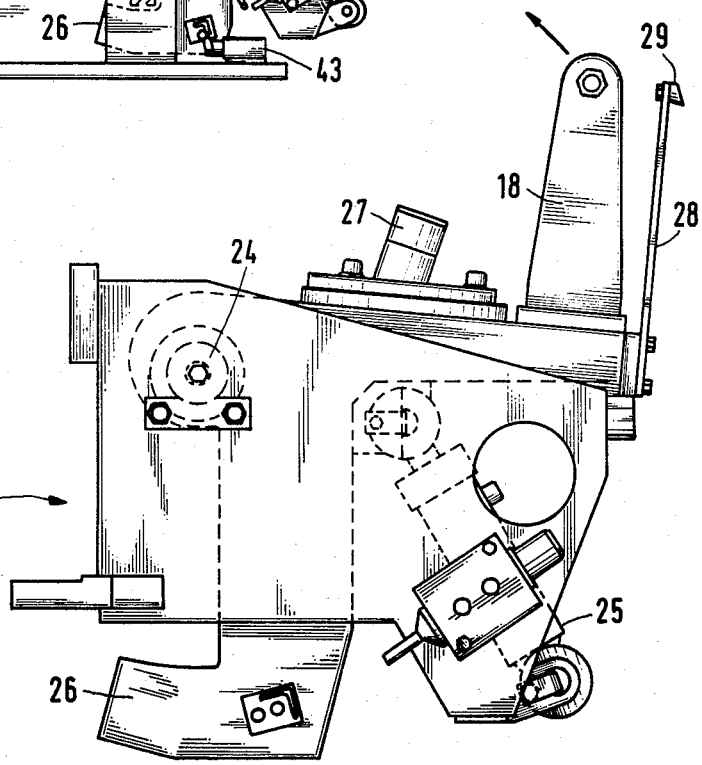
FIG. 4 is a side view, on an enlarged scale, of the actuating device of the coupling of the propeller device of FIG. 1.

FIG. 4 is a side view of the actuating device 17 of the coupling of the propeller device. The actuating device 17 includes a displacing lever 18 pivoting around a shaft 24 and displaced by a hydraulic cylinder 25. In FIG. 4, the displacing lever 18 is in its extreme position to the right. The situation thus corresponds to FIGS. 1 and 3, in which the drive shaft 14 of the propeller device 3 is in engagement with the shaft 12 coming from the engine. The displacing lever 18 is displaced to the left in FIG. 4 by the hydraulic cylinder 25, so that the intermediate shaft 16 is shifted to the left in axial direction and the coupling is disengaged or decoupled. At the same time, the locking hook 26 connected to the displacing lever 18 is opened and permits raising of the propeller device, and the brake 27 is pressed against the drive shaft 14, preventing the rotation of said shaft.

A rotating member 29, placed at the end of the spring 28, is provided in connection with the displacing lever 18 in the actuating device 17 of FIG. 4 for decoupling or disengaging the coupling. If the teeth in the toothed coupling are not in proper alignment during coupling or engaging of the coupling, the intermediate shaft 16 stops against the opposite sleeve 46 and the displacing lever 18 is displaced a little bit further. The rotating member 29 then grasps the teeth formed on the intermediate shaft 16 and rotates said shaft a little.

FIG. 5 shows the displacing levers 18 engaging at both sides of the intermediate shaft 16. The ends of the levers 18 are provided with rollers 30. During uncoupling of the coupling 15, the rollers 30 abut a shoulder 37 of the intermediate shaft 16 (FIG. 6) and shift said shaft to the left in FIGS. 1 and 3.

FIG. 6 is a sectional view of the coupling 15 between the drive shaft 14 of the propeller device and the shaft 12 of the engine. The coupling includes the sleeve-shaped intermediate shaft 16, which is connected to the sleeve 34 attached to the drive shaft 14 of the propeller device via the toothed coupling 35 and a flange 31. The sleeve 34 has internal teeth 47, and the intermediate shaft 16 has corresponding external teeth 48, so that said shaft may move in axial directions. The intermediate shaft 16 is urged to the right to its extreme position by a spring 33 in FIG. 6, thereby engaging or coupling the coupling 15.

The coupling is provided by a toothed coupling 36 between the intermediate shaft 16 and the sleeve 46 attached to the shaft 12 of the engine via a flange 32. The sleeve 46 of the toothed coupling 36 has internal teeth 50 and the intermediate shaft 16 has external teeth 51. The coupling is uncoupled or disengaged by shifting the intermediate shaft 16 to the left in FIG. 6 via the displacing lever 18, whereby the toothed coupling 36 is uncoupled or disengaged.

When the coupling 15 is being coupled or engaged, the displacing lever 18 of the actuating device 17 of said coupling moves to the right in FIG. 6, whereby the intermediate shaft 16 also moves to the right under the force of the spring 33. The shoulder 37 of the intermediate shaft 16 then rests against the roller 30 of the displacing lever 18. If the teeth 50 and 51 of the toothed coupling 36 are not in proper alignment with each other, the teeth 51 of the intermediate shaft 16 remain resting against the teeth 50 of the sleeve 46. However, the displacing lever 18 is capable of moving further to the right in FIG. 6, so that the rotating member 29 connected to said displacing lever grasps a tooth rim 39 attached to the intermediate shaft 16 and rotates said shaft a little bit. The teeth 50 and 51 may be brought into alignment with each other by rotation of the intermediate shaft 16, whereby the toothed coupling 36 is coupled. The coupling 15 is coupled in the aforedescribed manner and the shaft 12 of the engine is thereby coupled to the drive shaft 14 of the propeller device.

Since it is possible that an angular error or a lateral shift may occur in the transmission shafts, both of the toothed couplings 35 and 36 are spherical. The rims of the external teeth 48 and 51 at the ends of the intermediate shaft 16 are spherical. However, the rims of the internal teeth 47 and 50 of the sleeves 34 and 46 are linear.

FIG. 7 is a horizontal sectional view of FIG. 1 taken at the frame portion 7 of the propeller device. As shown in FIG. 7, the lower angular gearbox 6 and the annular propeller nozzle 4 surrounding the propeller, both of the lower part of the propeller device, fit exactly into the well 8 formed in the bottom 2 of the ship. A vertical shaft (not shown in the FIGS.) of the transmission equipment is positioned within the cylindrical frame portion 7. Because of the horizontal forces produced by the propeller, the lower end of the frame portion 7 is supported on the hull of the ship 1 by a support plate 42. Since the propeller device must be shifted in the vertical direction, the support plate 42 has a slide ring 43 mounted thereon. The slide ring 43 is positioned around a raising cylinder 22 acting as a guide. The raising cylinder 22 functions well as a guide, because it is securely affixed to the hull of the ship. The upper end of the raising cylinder 22 is affixed to the top 9 of the well 8, and its lower end is affixed to the wall of said well 8 by support brackets 20. A piston 21 in the hydraulic cylinder 22 passes through the top of the well 8, and has an upper end 23 affixed to an upper part of the propeller device, to produce a raising movement of the same.

The principal feature of the invention is that the propeller device is of simple structure, reliable in operation and readily remote-controllable due to the coupling, which is uncoupled or disengaged, as desired.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above-constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A propeller device for a ship, said propeller device having a propeller, an upper part and a lower part, and a transmission system for transmitting rotation from an engine having an engine shaft to said propeller, said transmission system including a drive shaft in the upper part of said propeller device, said drive shaft being driven by said shaft of said engine, an upper angular gearbox coupled to said drive shaft, a vertical shaft coupled to said upper angular gearbox, a lower angular gearbox coupled to said vertical shaft, and a propeller shaft in the lower part of said propeller device coupled to said lower angular gearbox, said propeller device comprising a coupling having a coupling member between said drive shaft of said propeller device and said engine shaft whereby said propeller device may be uncoupled from said engine via said coupling member, said coupling member being displaceable in axial directions, so that said propeller device may be raised, said ship having a bottom and a well formed in said bottom, said well having a top and a wall, said propeller device being positioned underneath the bottom of said ship in use, so that said propeller device may be raised into said well when out of operation, said propeller device further comprising raising means for raising said propeller device into said well, said raising means including a vertical hydraulic cylinder in said well alongside said propeller device, said cylinder having a bottom end affixed to said wall of said well and a top end affixed to the top of said well, a support plate supporting said propeller device at its lower part in said well, a slide ring mounted on said hydraulic cylinder and said hydraulic cylinder functioning as a guide, a piston in said hydraulic cylinder passing through the top of said well to above said top, and having an upper end affixed to the upper part of said propeller device, said piston producing a raising movement of said propeller device.

2. A propeller device as claimed in claim 1, wherein said coupling member comprises an intermediate shaft coupled to said drive shaft of said propeller device.

3. A propeller device as claimed in claim 2, further comprising a toothed coupling for coupling said intermediate shaft to said drive shaft, said toothed coupling permitting axial movement of said intermediate shaft relative to said drive shaft.

4. A propeller device as claimed in claim 3, further comprising another toothed coupling for coupling said intermediate shaft to said engine shaft.

5. A propeller device as claimed in claim 2, further comprising a spring urging said intermediate shaft toward said engine shaft, so that said coupling remains coupled.

6. A propeller device as claimed in claim 1, wherein said raising means further comprises a fastening bracket affixing the bottom end of said vertical hydraulic cylinder to said wall of said well.

7. A propeller device for a ship, said propeller device having a propeller, an upper part and a lower part, and a transmission system for transmitting rotation from an engine having an engine shaft to said propeller, said transmission system including a drive shaft in the upper part of said propeller device, said drive shaft being driven by said shaft of said engine, an upper angular gearbox coupled to said drive shaft, a vertical shaft coupled to said upper angular gearbox, a lower angular gearbox coupled to said vertical shaft, and a propeller shaft in the lower part of said propeller device coupled to said lower angular gearbox, said propeller device comprising a coupling having a coupling member between said drive shaft of said propeller device and said engine shaft whereby said propeller device may be uncoupled from said engine via said coupling member, said coupling member being displaceable in axial directions, so that said propeller device may be raised, said coupling member comprising an intermediate shaft coupled to said drive shaft of said propeller device, a hydraulic actuating device, adapted to be controlled from a remote point, for shifting said intermediate shaft in an axial direction apart from said engine shaft to uncouple said coupling, a toothed coupling, coupling said intermediate shaft to said drive shaft, said toothed coupling permitting axial movement of said intermediate shaft relative to said drive shaft, and another toothed coupling, coupling said intermediate shaft to said engine shaft, and wherein said actuating device includes a rotating member acting on said another toothed coupling when said engine and drive shafts are coupled, and a locking hook supported on said ship for preventing raising of said propeller device from a lower position when said drive shaft and engine shaft are coupled and for preventing lowering of said propeller device to the lower position if said intermediate shaft is displaced axially to a position where said intermediate shaft would be if said drive shaft and engine shaft are coupled.

8. A propeller device as claimed in claim 7, wherein said toothed coupling and said another toothed coupling are spherical thereby permitting both an angular error and a lateral shift between the said drive shaft and engine shaft.

9. A propeller device for a ship, said propeller device having a propeller, an upper part and a lower part, and a transmission system for transmitting rotation from an engine having an engine shaft to said propeller, said transmission system including a drive shaft in the upper part of said propeller device, said drive shaft being driven by said shaft of said engine, an upper angular gearbox coupled to said drive shaft, a vertical shaft coupled to said upper angular gearbox, a lower angular gearbox coupled to said vertical shaft, and a propeller shaft in the lower part of said propeller device coupled to said lower angular gearbox, said propeller device comprising coupling means for rotatably coupling said drive shaft to said engine shaft, said coupling means having a coupling member mounted for axial displacement for coupling and uncoupling said drive shaft of said propeller device and said engine shaft and wherein when said coupling member is in a position so that said drive shaft is disengaged from said engine shaft, said propeller device may be raised, said coupling member comprising an intermediate shaft coupled to said drive shaft of said propeller device, a hydraulic actuating device, adapted to be controlled from a remote point, for shifting said intermediate shaft in an axial direction apart from said engine shaft to uncouple said drive shaft from said engine shaft, and for shifting said intermediate shaft in the opposite axial direction towards said engine shaft to couple said drive shaft with said engine shaft, and a rotating member adapted to rotate said intermediate shaft while coupling of said drive and engine shafts is effected.

10. A propeller device as claimed in claim 9, additionally comprising a locking hook supported on said ship for preventing raising of said propeller device from a lower position when said engine and drive shafts are coupled, and for preventing lowering of said propeller device to the lower position if said intermediate shaft is displaced axially to a position where said intermediate shaft would be if said engine and drive shafts are coupled.

11. A propeller device as claimed in claim 10, wherein said locking hook is adapted to prevent abutment of coupling components attached to said engine and drive shafts while said propeller device is being lowered.

12. A propeller device for a ship, said propeller device having a propeller, an upper part and a lower part, and a transmission system for transmitting rotation from an engine having an engine shaft to said propeller, said transmission system including a drive shaft in the upper part of said propeller device, said drive shaft being driven by said shaft of said engine, an upper angular gearbox coupled to said drive shaft, a vertical shaft coupled to said upper angular gearbox, a lower angular gearbox coupled to said vertical shaft, and a propeller shaft in the lower part of said propeller device coupled to said lower angular gearbox, said propeller device comprising coupling means for rotatably coupling said drive shaft to said engine shaft, said coupling means having a coupling member mounted for axial displacement for coupling and uncoupling said drive shaft of said propeller device and said engine shaft and wherein when said coupling member is in a position so that said drive shaft is disengaged from said engine shaft, said propeller device may be raised, said coupling member comprising an intermediate shaft coupled to said drive shaft of said propeller device, a hydraulic actuating device, adapted to be controlled from a remote point, for shifting said intermediate shaft in an axial direction apart from said engine shaft to uncouple said drive shaft from said engine shaft, and for shifting said intermediate shaft in the opposite axial direction towards said engine shaft to couple said drive shaft with said engine shaft, wherein said intermediate shaft has a shoulder and said actuating device includes a displacing lever supported against said shoulder of said intermediate shaft, and wherein said hydraulic actuating device further comprises a hydraulic cylinder engaging said displacing lever for pivoting the same, a pivoting shaft about which said displacing lever is pivoted, and means for pressing against said drive shaft to prevent rotation of the same when said drive shaft is disengaged from said engine shaft.

* * * * *